US007290785B2

(12) United States Patent
Dixon

(10) Patent No.: US 7,290,785 B2
(45) Date of Patent: Nov. 6, 2007

(54) ANGULAR ADJUSTMENT MECHANISM FOR SNOWBOARD BINDINGS

(76) Inventor: Philip Allan Dixon, 17795 Beargrass Mtn Rd., Missoula, MT (US) 59808

( * ) Notice: Subject to any disclaimer, the term of this patent is extended or adjusted under 35 U.S.C. 154(b) by 218 days.

(21) Appl. No.: 11/235,483

(22) Filed: Sep. 26, 2005

(65) Prior Publication Data

US 2007/0069486 A1 Mar. 29, 2007

(51) Int. Cl.
*B62B 15/00* (2006.01)

(52) U.S. Cl. ..... 280/617; 280/618; 280/629; 280/14.24

(58) Field of Classification Search ..... 280/601, 280/607, 11.3, 611, 613, 617, 618, 620, 629, 280/14.21, 14.22, 14.24
See application file for complete search history.

(56) References Cited

U.S. PATENT DOCUMENTS 5,499,837 A * 3/1996 Hale et al. ..... 280/607
5,586,779 A * 12/1996 Dawes et al. ..... 280/14.24
5,897,128 A * 4/1999 McKenzie et al. ..... 280/607
5,984,346 A * 11/1999 Keller ..... 280/634
6,203,051 B1 * 3/2001 Sabol ..... 280/607
6,318,749 B1 * 11/2001 Eglitis et al. ..... 280/607
6,491,310 B1 * 12/2002 Work ..... 280/14.24
7,063,346 B2 * 6/2006 Elkington ..... 280/618
7,168,710 B1 * 1/2007 Hennebry ..... 280/14.24

* cited by examiner

*Primary Examiner*—Christopher P. Ellis
*Assistant Examiner*—Brian Swenson

(57) ABSTRACT

The Angular Adjustment Mechanism for Snowboard Bindings positioned between the snowboard and boot bindings allows angular adjustment between the snowboard rider's boot bindings and the snowboard without the need for any tools or levers. The user can make adjustments at any time by weighting the board with either foot and lifting and rotating the opposite foot. A lifting action releases the mechanism allowing for the adjustment of angular orientation. Removal of the lifting force engages the locking mechanism preventing further angular movement.

7 Claims, 4 Drawing Sheets

ANGULAR ADJUSTMENT MECHANISM FOR SNOWBOARD BINDINGS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of snowboarding and more specifically to Angularly Adjustable Mechanism for Snowboard Bindings. Snowboard binding systems generally use a toothed disk bolted directly to the snowboard whereas the disk mates with a toothed recess in the boot binding. Altering the angular orientation is a time-consuming trial and error process necessitating disassembly and reassembly to eventually arrive -at a satisfactory alignment. However, a snowboarder may not use the same boot orientation for all snow surfaces. Half-pipes, slaloms, and downhill runs all might lend themselves to differing stances primarily the angular orientation of the bindings to the longitudinal axis of the snowboard.

In addition to the desirability of changing the angular orientation of the bindings to accommodate riding the snowboard over varying terrain, the bottom of the slope provides another opportunity for changing binding orientation. Typically after a downhill run, the snowboard rider will unbuckle one boot to propel himself or herself forward much like a skateboarder with the other boot still bound to the board. Unlike normal riding where the longitudinal axis of the snowboard is aligned side-to-side with feet and hips, during level-ground locomotion, the snowboard is aligned front-to-rear, with the boot still bound at a nearly perpendicular angle to what is anatomically comfortable. In addition to being very uncomfortable, it can lead to or exacerbate strains and other maladies in the leg. Using an Angularly Adjustable Mechanism for Snowboard Bindings, the rider in this situation can orient the boot still bound with the longitudinal axis of the snowboard and travel more easily and with greater comfort and safety, especially when mounting and dismounting the chair lift.

Prior devices have been invented for snowboard binding adjustment as described in the following patents:

| U.S Pat. No. | Patentee | Issue Date |
|---|---|---|
| 5,941,552 | Beran | Aug. 24, 1999 |
| 5,947,488 | Gorza | Sep. 7, 1999 |
| 5,028,068 | Donovan | Jul. 2, 1991 |
| 5,897,128 | McKenzie | Apr. 27, 1999 |
| 6,206,402 | Tanaka | Mar. 27, 2001 |
| 5,782,476 | Fardie | Jul. 21, 1998 |
| 5,667,237 | Lauer | Sep. 16, 1997 |
| 5,586,779 | Dawes | Dec. 24, 1996 |
| 6,318,749 | Eglitis | Nov. 20, 2001 |
| 6,022,040 | Buzbee | Feb. 8, 2000 |

The prior patents: U.S. Pat. No. 5,941,552 Adjustable Snowboard Binding Apparatus and Method, U.S. Pat. No. 5,947,488 Angular Adjustment Device, Particularly for a Snowboard Binding, U.S. Pat. No. 5,028,068 Quick-Action Adjustable Snow Boot Binding Mounting, U.S. Pat. No. 5,897,128 Pivotally Adjustable Binding For Snowboards, U.S. Pat. No. 6,206,402 Snowboard Binding Adjustment Mechanism, U.S. Pat. No. 5,782,476 Snowboard Binding Mechanism, U.S. Pat. No. 5,667,237 Rotary Locking Feature For Snowboard Binding, U.S. Pat. No. 5,586,779 Adjustable Snowboard Boot Binding Apparatus, and U.S. Pat. No. 6,318,749 Angularly Adjustable Snowboard Binding Mount all require a lever to lock and unlock angular adjustment device.

U.S. Pat. No. 6,022,040 Freely Rotating Step-In Snowboard Binding provides no means of locking the binding's swiveling device. A rider employing a snowboard equipped with this device would have far less control over the snowboard than a rigidly secured binding.

Unlike prior inventions, the Angular Adjustment Mechanism for Snowboard Bindings positioned between the snowboard and boot binding allows angular adjustment between the snowboard rider's boot bindings and the snowboard without the need for any tools or levers. The user can make adjustments at any time by weighting the board with either foot and lifting and rotating the opposite foot. A lifting action releases the mechanism allowing for the adjustment of angular orientation. Removal of the lifting force engages the locking mechanism preventing further angular movement.

BRIEF SUMMARY OF THE INVENTION

The primary object of the invention is the convenience of adjusting the angular orientation of the snowboard bindings easily at any time, even while in motion. Another object of the invention is no external levers or tools to perform the adjustment of binding orientation. Another object of the invention is no unintended angular motion. Another object of the invention is a device that is unaffected by board torsion. A further object of the invention is to use existing bolt holes on snowboards and boot bindings to allow a retrofit of conventional boards and bindings currently on the market.

In accordance with a preferred embodiment of the invention, there is disclosed an Angular Adjustment Mechanism for Snowboard Bindings comprising: upper plate, upper gear coupling, wave washer, upper retainer, lower retainer, and lower gear coupling.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1A:
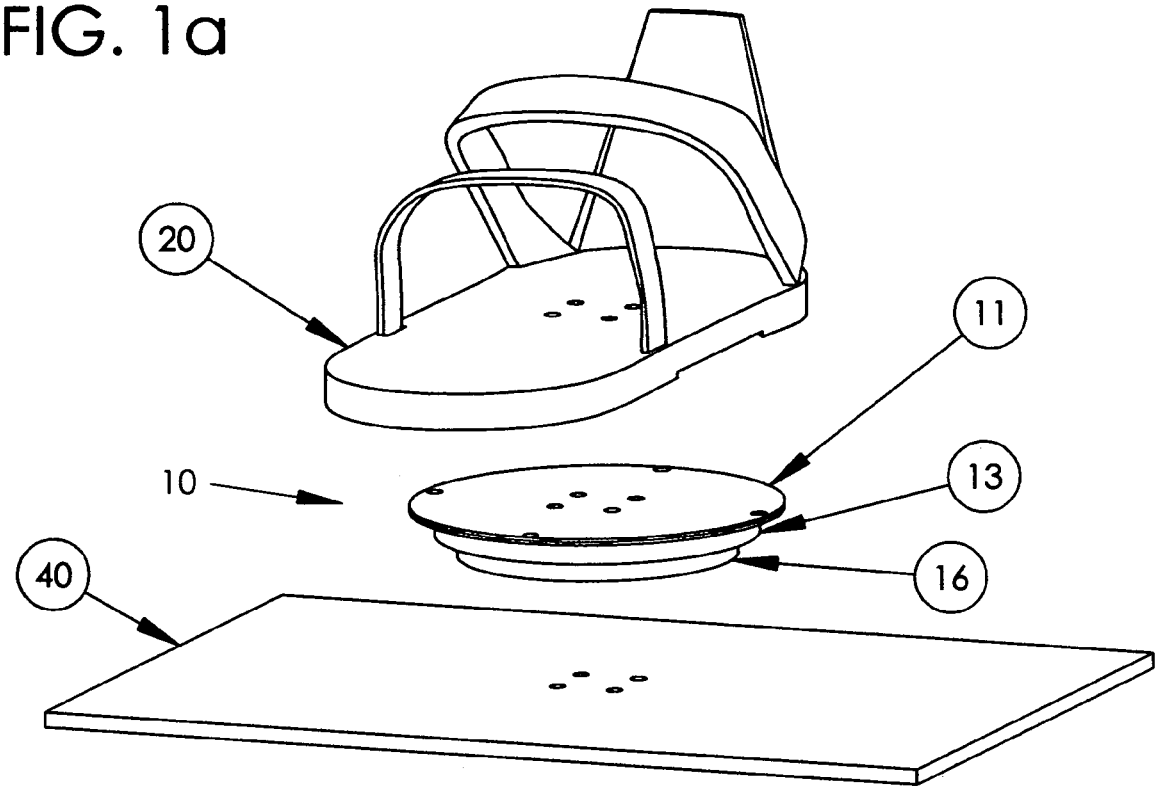
FIG. 1*a* is an exploded view showing the position of the invention relative to the snowboard and boot binding.
Figure 1B:
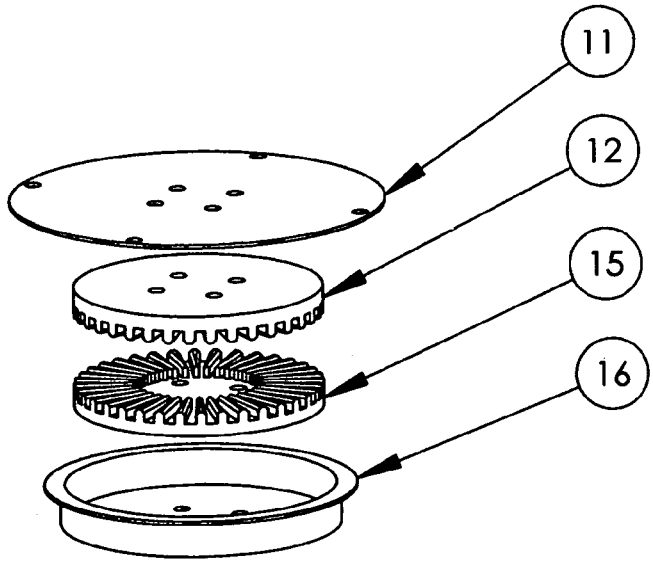
FIG. 1*b* is a perspective view of the portions of the invention which mate with the snowboard and boot binding.

In accordance with the present invention, FIG. 1*a* shows the position of Angular Adjustment Mechanism for Snowboard Bindings 10 in an exploded position relative to both boot binding 20 and section of snowboard 40. Those portions of the invention which mate rigidly to either the snowboard 40 or the boot binding 20 are shown in FIG. 1*b*. Referencing both FIGS. 1*a* and 1*b*, upper plate 11 and upper gear coupling 12 are shown with a bolt hole pattern matching that of boot binding 20 and, when incorporated, would mate rigidly to same. Lower retainer 16 and lower gear coupling 15 are shown with a bolt hole pattern matching that of snowboard 40 and, when incorporated, would mate rigidly to same. The components shown in use in Angular Adjustment Mechanism for Snowboard Bindings 10 in all figures are shown substantially thicker than necessary for purposes of clarity of illustration and can therefore be reduced in size for manufacturing.

Figure 2A:
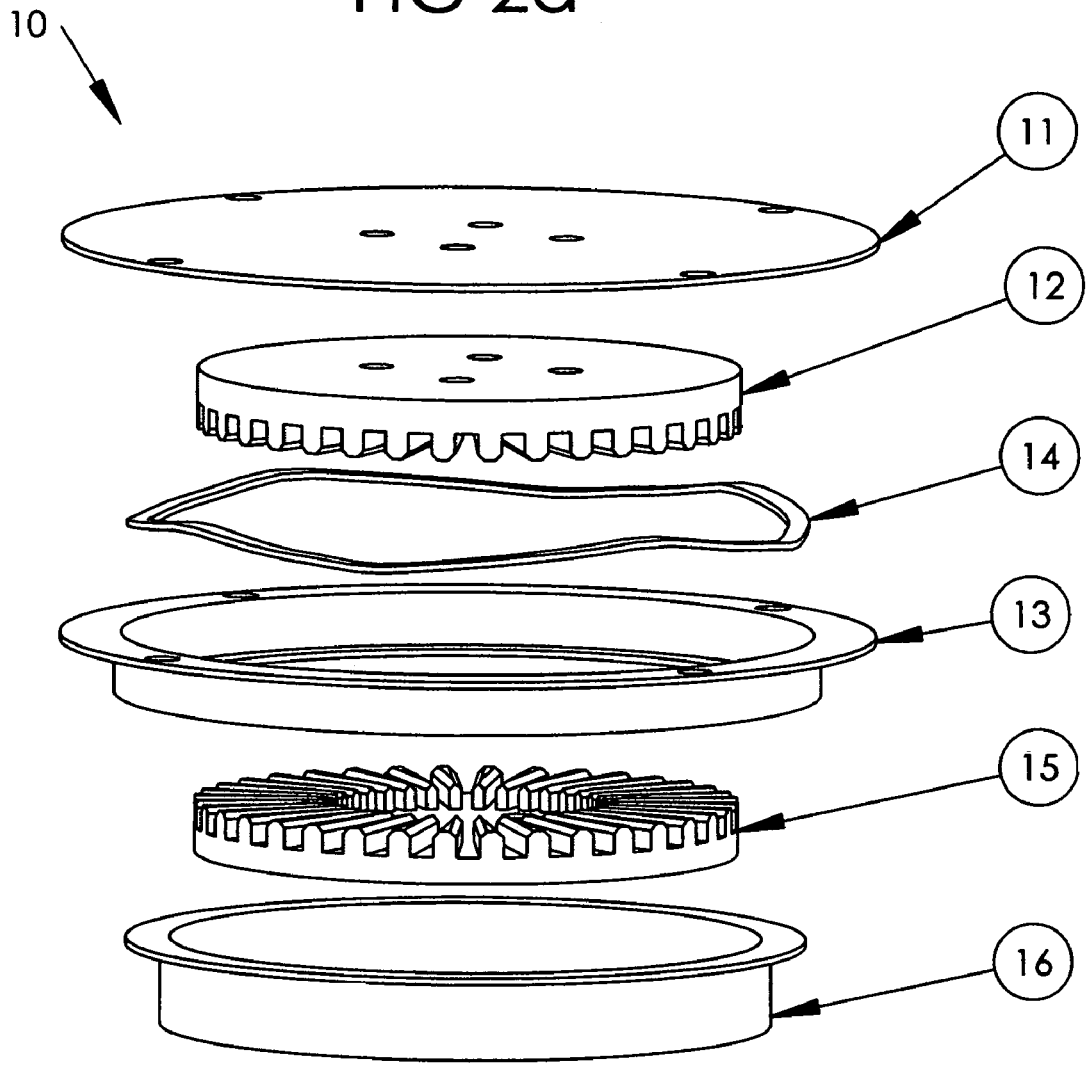
FIG. 2*a* is an exploded view of the invention.

FIG. 2*a* shows an exploded view of the Angular Adjustment Mechanism for Snowboard Bindings 10. Upper plate 11 and upper gear coupling 12 both mount rigidly to boot binding using bolts or similar fasteners (not shown). Lower retainer 16 and lower gear coupling 15, both mount rigidly to snowboard using bolts or similar fasteners (not shown). The upper retainer 13 features a lip at its top with bolt holes for affixing to upper plate 11 using bolts or similar fasteners (not shown). Inside the upper retainer 13, at its bottom is a lip extending inwards. The lower retainer 16 features a lip at its top extending outwards. When assembled, the lower lip of upper retainer 13 is below the upper lip of lower retainer 16 which prevents a detachment of upper retainer 13 and lower retainer 16 and provides an annular cavity between these two features. Within this cavity is positioned wave washer 14. Wave washer 14 provides a tension force that drives the combination of upper gear coupling 12 and lower gear coupling 15 together which locks the mechanism from rotating when external forces are absent.

Wave washer 14 is an undulating ring of spring steel that provides a resistive opposition to compression forces. Washers of differing stiffness or a plurality of washers could be made available to fit the user's preferences. Alternative components might include belleville washers, compression springs, or elastomers.

Upper plate 11 and upper gear coupling 12 are shown as separate items but can be constructed as one piece. Furthermore, lower retainer 16 and and lower gear coupling 15 are shown as separate items but can be constructed as one piece.

Upper gear coupling 12 and lower gear coupling 15 are plates with one side comprised of radially-extending raised teeth. When upper gear coupling 12 and lower gear coupling 15 are engaged (teeth of one extended into the recesses of the other), radial forces from the rider can be transmitted to the snowboard. Upper gear coupling 12 and lower gear coupling 15 are shown with a coarse tooth spacing for clarity of illustration, but more closely-spaced teeth would provide for a wider selection of boot angular orientation.

Figure 2B:
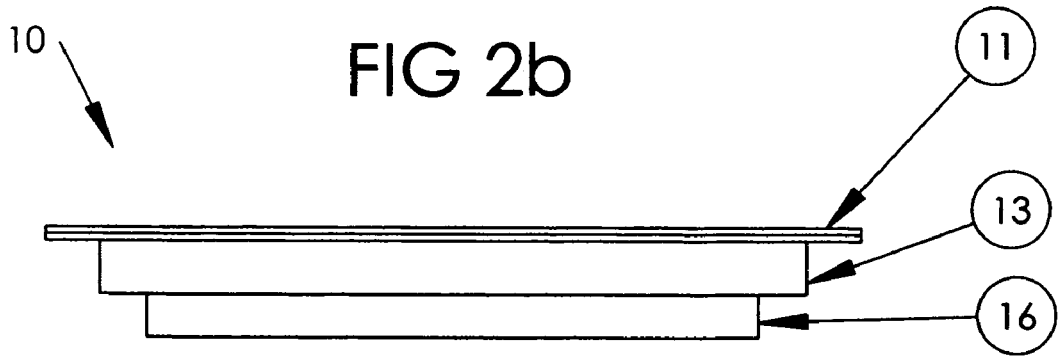
FIG. 2*b* is a side view of the assembled invention.

FIG. 2*b* shows a side view of the mechanism fully assembled. As shown, there is upper retainer 13 fastened to upper plate 11. Also visible is lower retainer 16.

Figure 3A:
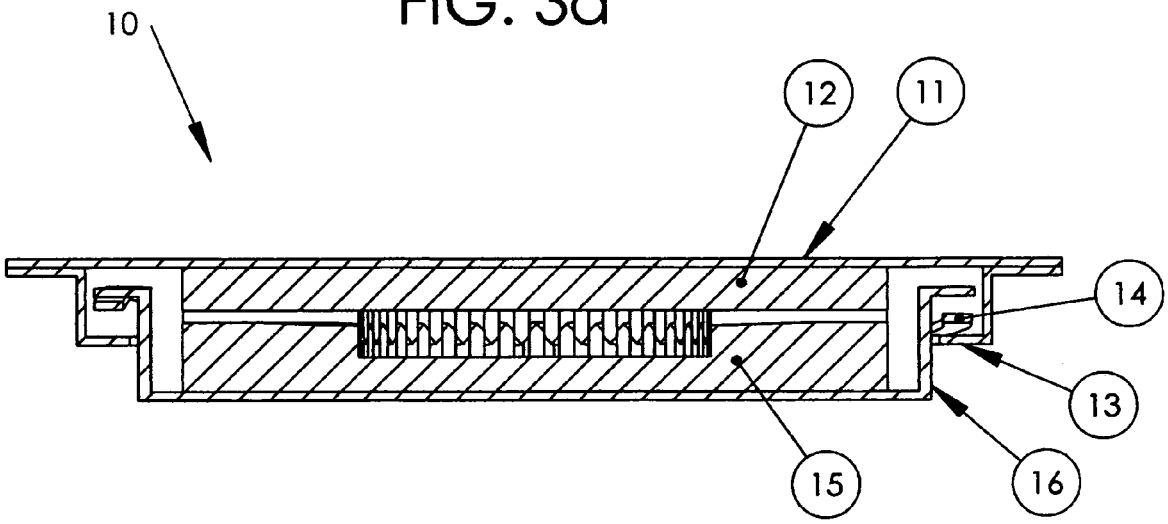
FIG. 3*a* is a cross sectional side view of the invention in its engaged configuration.
Figure 3B:
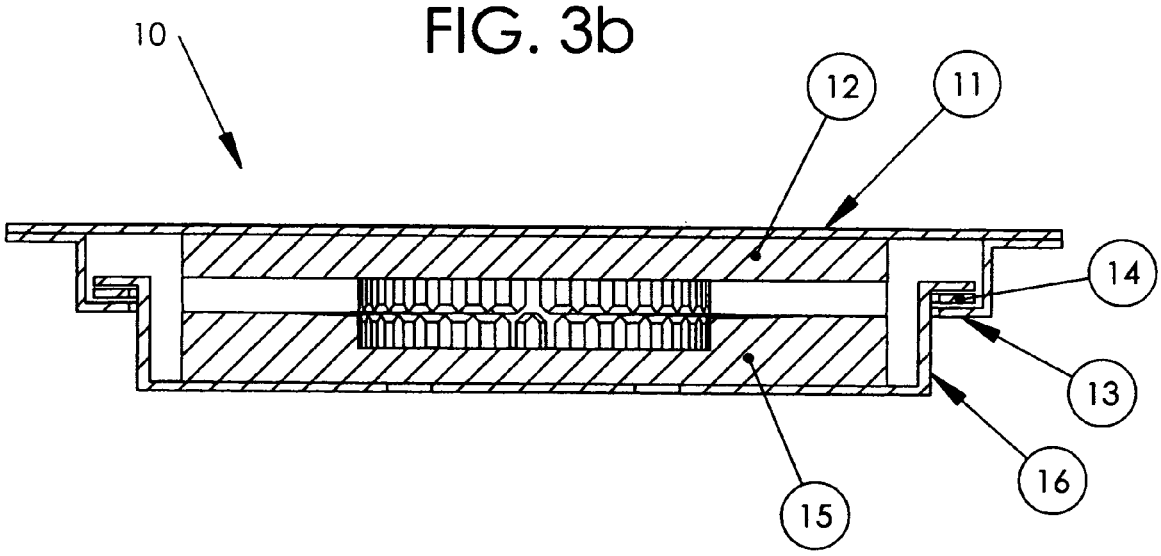
FIG. 3*b* is a cross sectional side view of the invention in its disengaged configuration.

To illustrate the principles of operation, there is shown in FIGS. 3*a* and 3*b* cross-sectional side views of the assembled mechanism. Upper plate 11 and upper gear coupling 12 are both mounted rigidly to the boot binding. Lower retainer 16 and lower gear coupling 15 are both mounted rigidly to snowboard. Upper retainer 13 would be positioned as shown surrounding lower retainer 16. The lower lip of upper retainer 13 is a slip fit over the vertical side walls of lower retainer 16 such that relative vertical motion is allowed, but snow and grime will not pass the touching surfaces to get inside. Wave washer 14 is positioned within the cavity formed by the lower inside lip of upper retainer 13 and the upper outside lip of lower retainer 16.

While there are no external forces on the mechanism shown in FIG. 3*a*, the wave washer 14 exerts pressure upward against lower retainer 16 and simultaneously downward against upper retainer 13. This forces the upper part of the assembly (upper plate 11, upper gear coupling 12, and upper retainer 13) down against the lower part of the assembly (lower gear coupling 15 and lower retainer 16), thereby forcing together into a mating relationship upper gear coupling 12 and lower gear coupling 15, which prevents any angular rotation of the top portion with respect to the lower portion.

FIG. 3*b* illustrates the mechanism when it is disengaged. When the upper portion of the assembly (upper plate 11, upper gear coupling 12, and upper retainer 13) which is attached rigidly to the boot binding is forced upward while simultaneously the lower portion of the assembly (lower gear coupling 15 and lower retainer 16) which is attached to the snowboard is forced downward, the resistance to compression of the wave washer 14 is overcome. The wave washer 14 then becomes substantially flattened as the upper and lower portions of the assembly are forced apart. When the separation of the upper and lower portions of the assembly become sufficiently great, the upper gear coupling 12 and lower gear coupling 15 become disengaged and the upper portion of the assembly is free to swivel in an angular direction with respect to the lower portion.

Figure 4A:
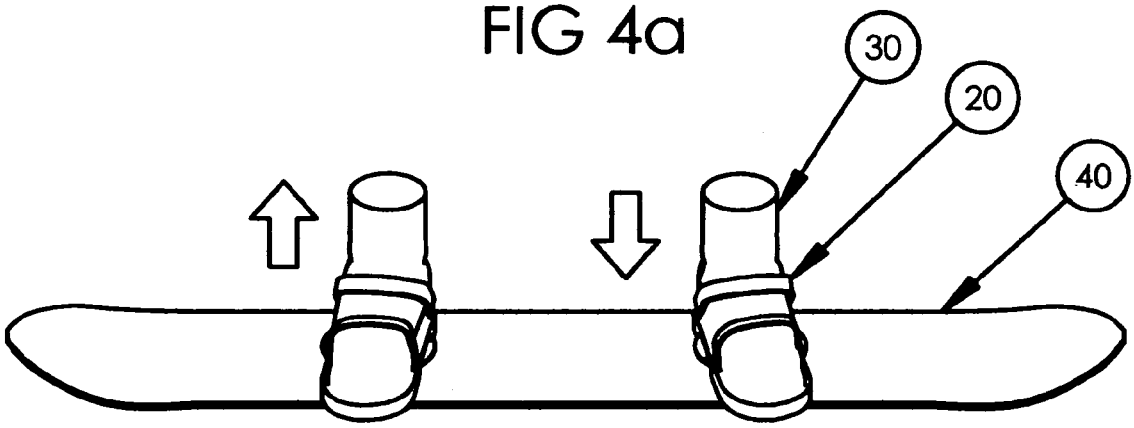
FIG. 4*a* and FIG. 4*b* are perspective views of the invention illustrating its use.
Figure 4B:
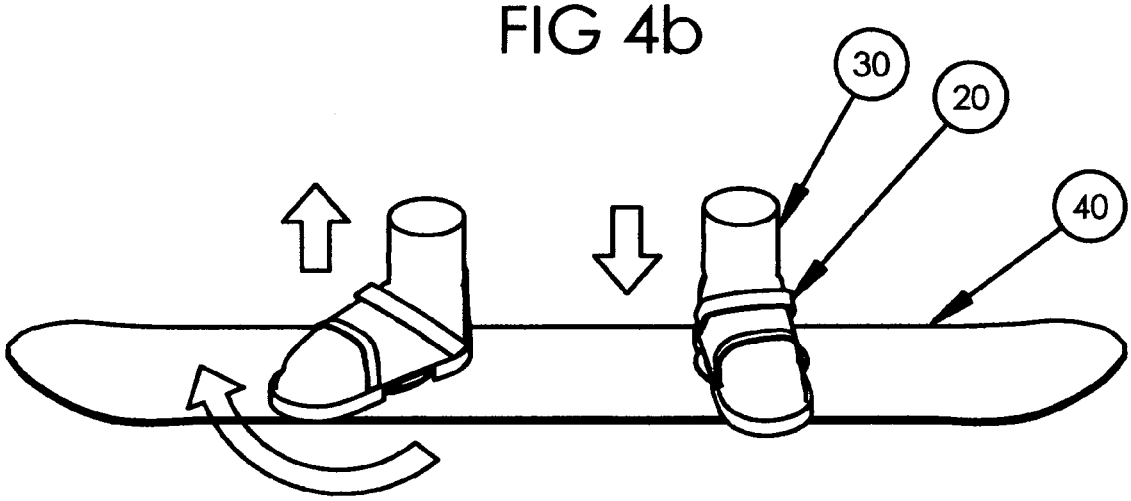

In accordance with the present invention, FIGS. 4*a* and 4*b* illustrate a typical application. In these figures, the present invention Angular Adjustment Mechanism for Snowboard Bindings is mounted between the underside of boot binding 20 and the upper surface of snowboard 40 and is therefore concealed from view. In a static circumstance (no external forces applied), the Angular Adjustment Mechanism for Snowboard Bindings is locked and no angular motion is possible. To initiate intended angular repositioning, in FIG. 4*a*, the snowboard rider puts his or her weight on one boot 30 (indicated in the figure by the "down" arrow). Simultaneously, the rider lifts up on the other boot (indicated in the figure by the "up" arrow) which disengages the locking feature of the Angular Adjustment Mechanism for Snowboard Bindings which permits the angular rotation of the boot 30 in any orientation desirable (FIG. 4*b*). Relieving the opposing forces on the Angular Adjustment Mechanism for Snowboard Bindings re-engages the locking mechanism prohibiting further angular motion. The preceding steps may be repeated in the opposite order to adjust the other boot's angular orientation.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An Angular Adjustment Mechanism for Snowboard Bindings which can be rotated and locked to selected orientation angles with respect to the snowboard without the use of levers or tools comprising:

an upper plate adapted to be fixedly mounted onto boot binding;

a upper gear coupling with a plurality of radially-extending raised teeth mounting onto said upper plate;

an upper retainer mounting onto said upper plate having an inwardly directed lip;

a lower retainer adapted to be fixedly mounted onto an upper surface of a snowboard, said lower retainer having an outwardly directed lip contained within said inwardly directed lip of said upper retainer preventing the detachment of said upper retainer and said lower retainer;

a lower gear coupling with a plurality of radially-extending raised teeth mounting onto said lower retainer and;

at least one wave washer positioned between said outwardly directed lip of said lower retainer and said inwardly directed lip of said upper retainer providing a resistive force to the separation of said upper retainer and said lower retainer and providing a resistive force to the separation of said upper gear coupling and said lower gear coupling.

2. An Angular Adjustment Mechanism for Snowboard Bindings according to claim 1 wherein said upper plate and said upper gear coupling are constructed as one piece.

3. An Angular Adjustment Mechanism for Snowboard Bindings according to claim 1 wherein said lower retainer and said lower gear coupling are constructed as one piece.

4. An Angular Adjustment Mechanism for Snowboard Bindings according to claim 1 wherein said wave washer is replaced by at least one belleville washer.

5. An Angular Adjustment Mechanism for Snowboard Bindings according to claim 1 wherein said wave washer is replaced by at least one compression spring.

6. An Angular Adjustment Mechanism for Snowboard Bindings according to claim 1 wherein said wave washer is replaced by at least one elastomer washer.

7. An Angular Adjustment Mechanism for Snowboard Bindings according to claim 1 wherein said outwardly directed lip of said lower retainer is reversed to an inwardly directed lip and said inwardly directed lip of said upper retainer is reversed to an outwardly directed lip and the functional relationship is thereby maintained.

* * * * *